US005460129A

United States Patent [19]

Miller et al.

[11] Patent Number: 5,460,129

[45] Date of Patent: Oct. 24, 1995

[54] METHOD TO REDUCE ENGINE EMISSIONS DUE TO MISFIRE

[75] Inventors: John M. Miller, Saline; John V. James, Walled Lake, both of Mich.

[73] Assignee: Ford Motor Company, Dearborn, Mich.

[21] Appl. No.: 317,010

[22] Filed: Oct. 3, 1994

[51] Int. Cl.[6] ..... F01L 13/00

[52] U.S. Cl. ..... 123/90.15; 123/198 F

[58] Field of Search ..... 123/90.15, 90.16, 123/90.17, 90.12, 90.13, 481, 198 F

[56] References Cited

U.S. PATENT DOCUMENTS

| | | | |
|---|---|---|---|
| 3,714,932 | 2/1973 | Meacham et al. | 123/75 E |
| 3,815,558 | 6/1974 | Tenney | 123/73 A |
| 4,009,695 | 3/1977 | Ule | 123/90.13 |
| 4,188,933 | 2/1980 | Iizuka | 123/198 F |
| 4,469,061 | 9/1984 | Ajiki et al. | 123/198 F |
| 4,716,863 | 1/1988 | Pruzan | 123/90.15 |
| 4,930,481 | 6/1990 | Fujimoto et al. | 123/481 |
| 4,936,263 | 6/1990 | Tamba et al. | 123/90.27 |
| 4,974,566 | 12/1990 | LoRusso et al. | 123/308 |
| 5,115,790 | 5/1992 | Kawamura | 123/571 |
| 5,123,397 | 6/1992 | Richeson | 123/568 |
| 5,284,116 | 2/1994 | Richeson, Jr. | 123/425 |
| 5,287,829 | 2/1994 | Rose | 123/90.12 |

*Primary Examiner*—David A. Okonsky
*Assistant Examiner*—Weilun Lo
*Attorney, Agent, or Firm*—Allan J. Lippa; Roger L. May

[57] ABSTRACT

A control system and control method are described for an engine (12) having a valve controller (42) for controlling exhaust valves ($EV_{1-4}$) and intake valves ($IV_{1-4}$) of each of the cylinders. Misfire detectors (210–302) provide an indication of ignition misfire in each of the cylinders each engine cycle. In response to a misfire detection, the valve lift of the exhaust valve for that cylinder is set to zero. If the misfire was absent during the cylinder's previous ignition cycle, the intake valve lift is also set to zero. After two successive misfire detections, the intake valve lift is set to a predetermined lift in order to refreshen the air/fuel charge which has been trapped in the cylinder from the previous engine cycles (402–428).

16 Claims, 7 Drawing Sheets

METHOD TO REDUCE ENGINE EMISSIONS DUE TO MISFIRE

BACKGROUND OF THE INVENTION

The field of the invention relates to detecting misfires in an internal combustion engine. Engine misfire indicating systems are known which provide an indication of engine misfire in response to changes in crankshaft acceleration. Other systems are known which provide indications of engine misfire and response to variations of alternator current.

Engine misfire indicating systems are also known which provide an indication of engine misfire for each engine cylinder. More specifically, ionization systems are utilized which monitor ionization current through the sparkplug electrodes to provide an indication of cylinder misfire. It is also known to provide indications of cylinder misfire in response to monitoring cylinder pressure. Pressure sensors have been coupled either directly to the combustion chamber or to the engine head.

The inventors herein have recognized numerous problems with previous misfire systems. For example, misfire and a resultant increase in engine emissions due to misfire continues until the fault is detected and subsequently repaired.

SUMMARY OF THE INVENTION

An object of the present invention is to detect a misfire of an air/fuel charge for each engine cylinder and prevent discharge of the misfired air/fuel charge into the engine exhaust.

The above problems and disadvantages are overcome, and object achieved, by providing both a control system and a control method for a multi-cylinder engine. In one particular aspect of the invention, the control system comprises: a misfire detector for detecting a misfire in at least one of the cylinders; and a valve controller for controlling an exhaust valve of the cylinder, the valve controller at least partially closing the exhaust valve in response to the misfire detection. Preferably, the valve controller further controls and intake valve of the cylinder and the valve controller at least partially closes the intake valve in response to the misfire detection. In addition, the valve controller, preferably, partially opens the intake valve in response to misfire detection during the cylinder's previous ignition cycle.

An advantage of the above aspect of the invention is that a misfired air/fuel charge is prevented from entering the engine exhaust and the resulting increase in engine emissions is thereby avoided or substantially reduced. An additional advantage is that the misfired air/fuel charge is retained in the cylinder for ignition during subsequent engine cycles. Still another advantage is that the misfired air/fuel charge is refreshened with additional air and fuel by partially opening the intake valve during subsequent engine cycles.

In another aspect of the invention, a control method is provided for a multi-cylinder engine having a valve controller for controlling exhaust valves and intake valves of each of the cylinders and a misfire detector coupled to each of the cylinders. The method comprises the steps of:

detecting an ignition misfire for each of the cylinders for each ignition cycle of each of the cylinders; setting valve lift of an exhaust valve of one of the cylinders to zero in response to a misfire detection for the cylinder; setting valve lift of an intake valve of the cylinder to zero in response to said misfire detection for the cylinder when the misfire detection was absent during the cylinder's previous ignition cycle; and setting the intake valve lift to a predetermined lift in response to two successive misfire detections for the cylinder.

An advantage of the above aspect of the invention is that the misfired air/fuel charge is held in the cylinder by closing the exhaust valve thereby preventing or reducing an increase in engine emissions. Another advantage is that the misfired air/fuel charge is subsequently ignited in the cylinder thereby preventing or reducing an increase in engine emissions. Still another advantage, is that the air/fuel charge retained in the cylinder is freshened with additional air and fuel after two successive misfire detections, thereby enhancing reignition during a subsequent engine cycle and, again, preventing or reducing an increase in engine emissions.

DESCRIPTION OF THE DRAWINGS

The object and advantages described above will be better understood by reading a description of an example of an embodiment in which the invention is used to advantage with reference to the drawings wherein.

DESCRIPTION OF THE EMBODIMENT

Figure 1:
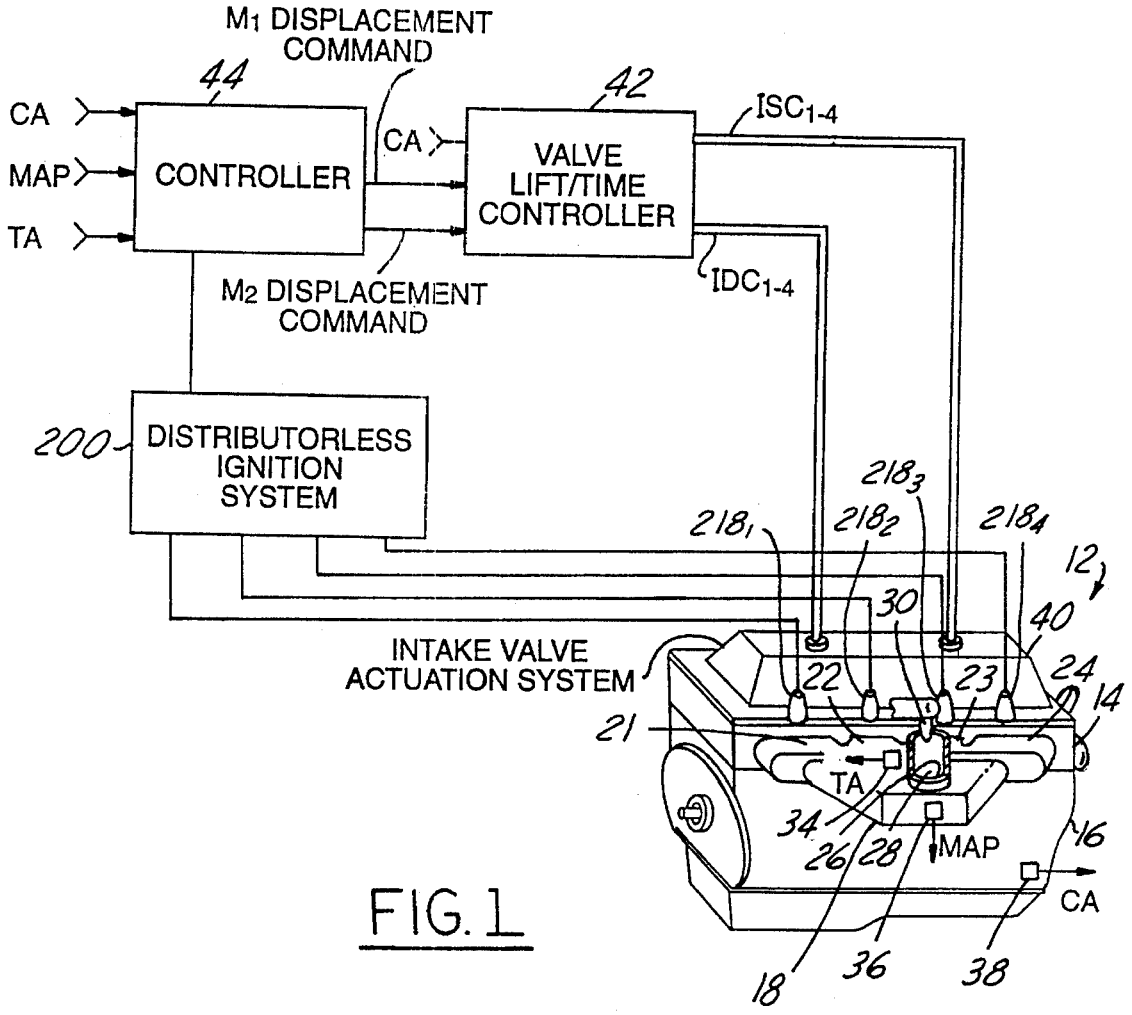
FIG. 1 is a block diagram of an embodiment in which the invention is used to advantage.

Referring first to FIG. 1, internal combustion engine 12 is shown including cylinder head 14 coupled to engine block 16. Intake manifold 18 is shown having runners 21, 22, 23, and 24 coupled to respective combustion chambers 1, 2, 3, and 4 (not shown) via cylinder head 14. Air/fuel intake 26, having conventional throttle plate 28 positioned therein and coupled to fuel injector 30, is shown connected to intake manifold 18 for providing an air/fuel mixture to the combustion chambers.

Conventional sensors are shown coupled to engine 12 for providing measurements of various engine operating parameters. In this particular example, throttle angle sensor 34 provides signal TA related to the throttle position of throttle plate 28. Manifold pressure sensor 36 is shown coupled to intake manifold 18 for providing signal MAP related to the manifold pressure therein. Crank angle sensor 38 is coupled to the engine crankshaft (not shown) for providing signal CA related to angular position of the crankshaft.

It is noted that other conventional engine components such as a fuel delivery system, exhaust manifold and exhaust gas recirculation system are not shown in FIG. 1 because they are well known and not necessary for an understanding of the invention. It is also noted that various lift displacements may be used to throttle the engine in which case throttle plate 28 would not be needed.

As described in greater detail later herein with particular reference to FIGS. 2–7, intake valve actuation system 40 (FIG. 2) controls the lift displacement profile and lift timing of intake valves $IV_1$, $IV_2$, $IV_3$, and $IV_4$. Intake valve actuation system 40 is responsive to inlet supply command signals $ISC_{1-4}$ and intake drain command signals $IDC_{1-4}$ from valve lift/timing controller 42. Maximum valve lift displacement is determined by maximum displacement command signals from controller 44 in response to signal MAP, signal TA, and signal CA. In general terms, which are described in greater detail later herein, intake valve actuation system 40 provides for at least one of two maximum valve lift displacements dependent upon either the $M_1$ displacement command or the $M_2$ displacement command from controller 44. For example, during high load conditions as determined by controller 44 from signal MAP, maximum valve displacement $M_2$ is provided by valve lift/timing controller 42 such that each intake valve clears the cylinder head mask, (not shown). In this manner, maximum volume of flow per unit of time of the inducted mixture is provided. During normal operating conditions, as determined by controller 44, peak lift displacement is limited to maximum valve $M_1$ such that each intake valve does not clear the cylinder head mask thereby maximizing rotational movement (swirl or tumble) of the inducted mixture.

As described in greater detail later herein with particular reference to FIGS. 8–10, conventional distributorless ignition system 200, including two sets of primary and secondary coils, is shown coupled to spark plugs $\mathbf{218_1}$, $\mathbf{218_2}$, $\mathbf{218_3}$, and $\mathbf{218_4}$ of engine 12 (each secondary coil is coupled to a pair of sparkplugs).

Figure 2:
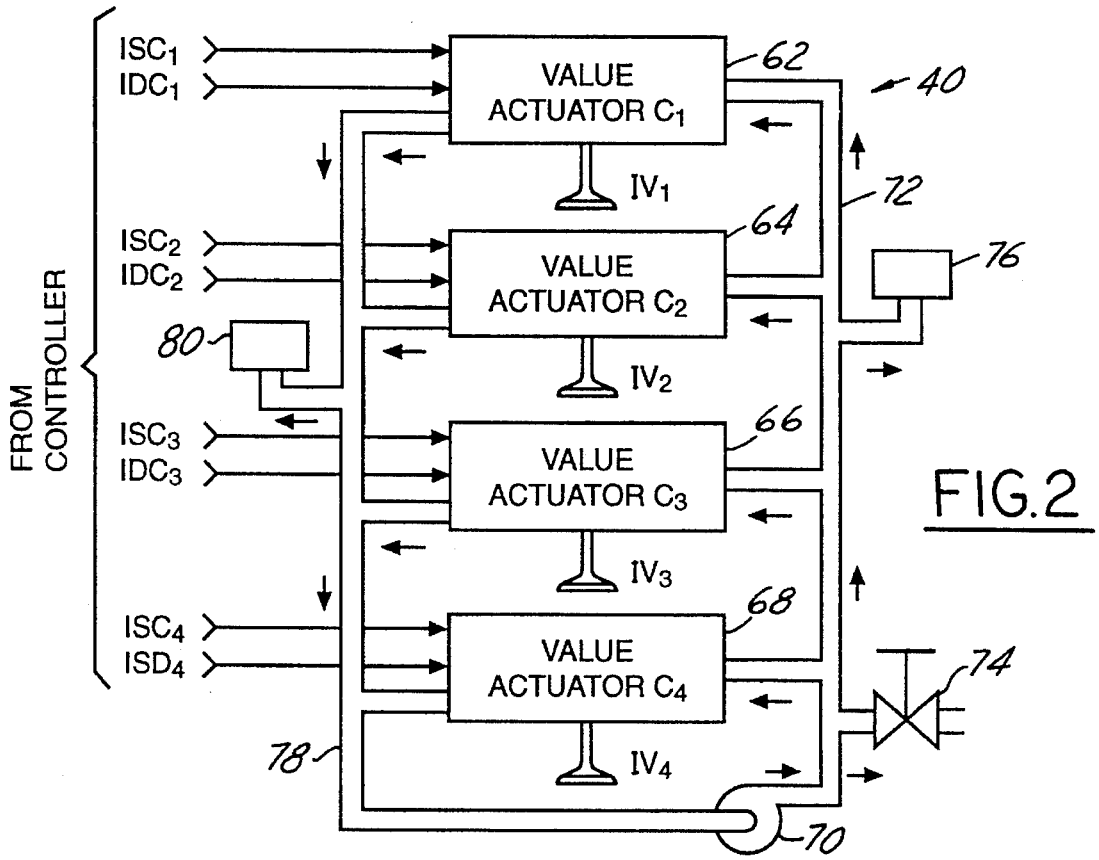
FIG. 2 is a block diagram of an intake valve actuation system shown in FIG. 1.

Referring to FIG. 2, a block diagram of one example of intake valve actuation system 40 is shown including valve actuator assemblies 62, 64, 66, and 68 connected to respective engine intake or inlet valves $IV_1$, $IV_2$, $IV_3$, and $IV_4$. Variable displacement pump 70 is shown supplying pressurized hydraulic fluid to the intake valve actuator assemblies via supply line 72. Conventional relief valve 74 and high pressure accumulator 76 are also shown coupled to supply line 72. Pump 70 is shown receiving hydraulic fluid from the intake valve actuator assemblies via return line 78. Low pressure accumulator 80 is shown coupled to return line 78. As described in greater detail later herein, intake valve actuator assembly 62 is responsive to intake supply command $ISC_1$ and intake drain command signal $IDC_1$ from valve lift/timing controller 58. Similarly, valve actuator assemblies 64, 66, and 68 are responsive to respective command signals $ISC_2$, $IDC_2$, $ISC_3$, $IDC_3$, $ISC_4$, and $IDC_4$.

Figure 3:
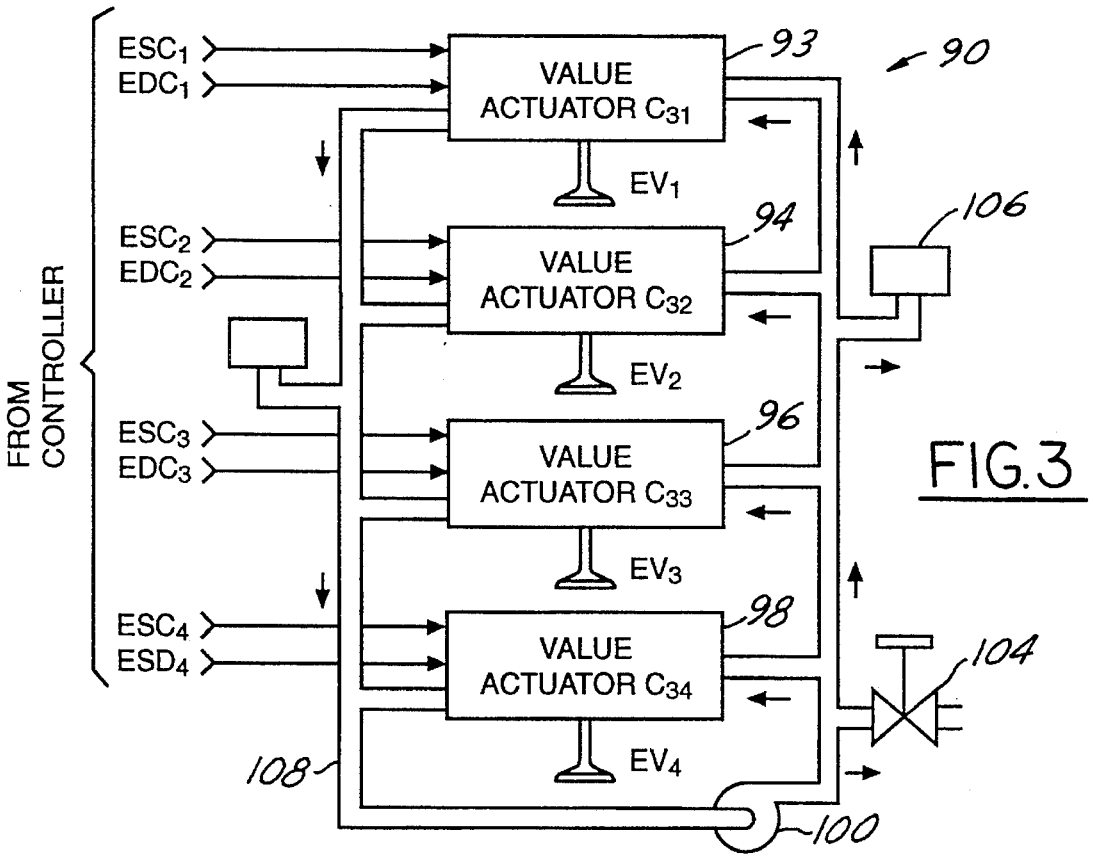
FIG. 3 is a block diagram of an exhaust valve actuation system included in the embodiment shown in FIG. 1.

An optional exhaust valve actuation system 90 is shown in FIG. 3 having the same structure and operation as intake valve actuation system 70 which was previously described with reference to FIG. 2. Valve actuator assemblies 92, 94, 96 and 98 are shown connected to respective engine exhaust valves $EV_1$, $EV_2$, $EV_3$, and $EV_4$. Valve actuation assemblies 92, 94, 96, and 98 are responsive to respective command signals $ESC_1$, $EDC_1$, $ESC_2$, $EDC_2$, $ESC_3$, $EDC_3$, $ESC_4$, $EDC_4$. Pump 100 is coupled to each valve actuator assembly via supply line 102 and return line 108. Supply line 102 is coupled to high pressure accumulator 106 and vent 104. Return line 108 is shown coupled to each valve actuator assembly and also coupled to low pressure accumulator 110.

Figure 4:
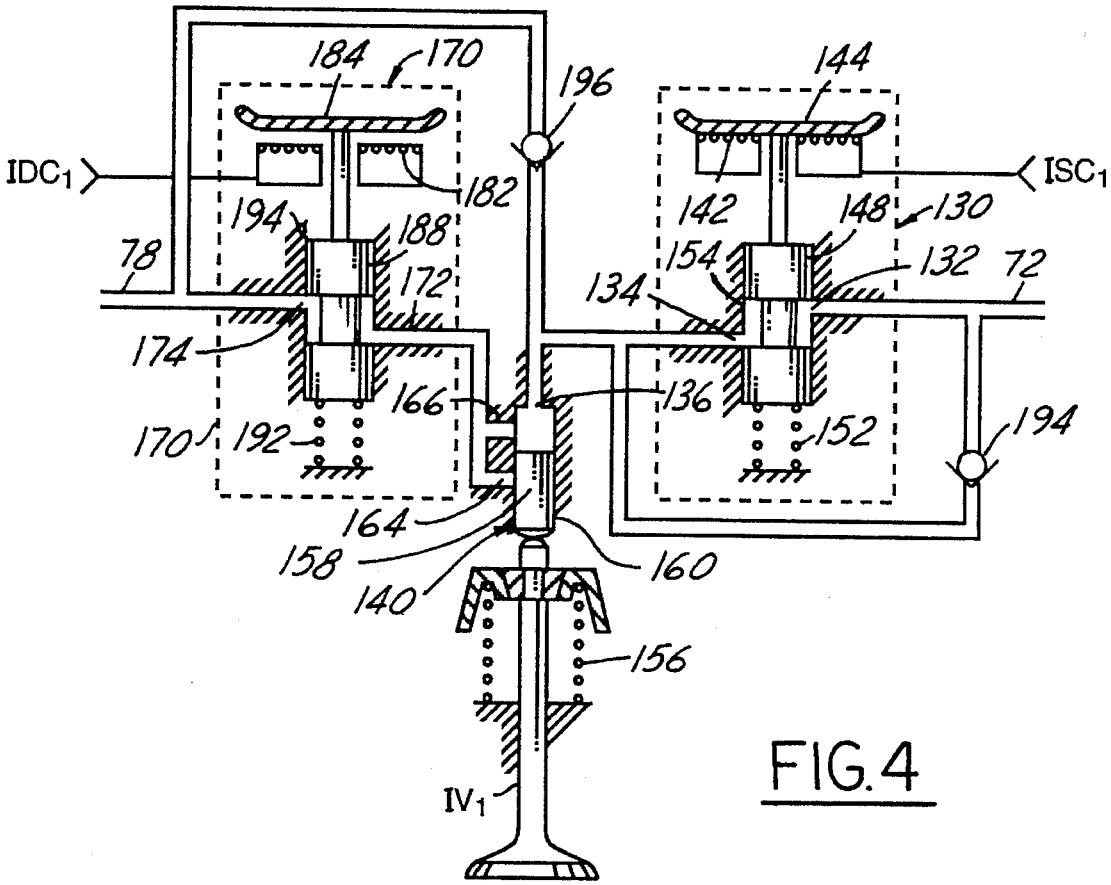
FIG. 4 illustrates a portion of the valve actuation system shown in FIG. 3, which is referred to as a valve actuation assembly.

Referring to FIG. 4, the structure and operator of the valve actuators is now described. Although a single valve actuator (62) is shown, the related description is applicable to valve actuators 64, 66, 68, 92, 94, 96 and 98. Valve actuator assembly 62 is shown including supply valve 130, hydraulic actuator 140, and drain valve 170. Supply valve 130, shown in this example as initially being in its closed position, includes fluid input 132 coupled to hydraulic supply line 72 and fluid output 134 coupled to fluid input 136 of hydraulic actuator 140. Supply valve 130 includes coils 142 responsive to intake supply command $ISC_1$ and electromagnetically coupled to armature 144. Spool valve 148 is shown coupled to both armature 144 and return spring 152 within casing 154. Accordingly, hydraulic supply line 72 is coupled to hydraulic actuator 140 when $ISC_1$ is not active.

Intake valve $IV_1$ is shown coupled between hydraulic actuator 140 and return spring 156. Hydraulic actuator 140 is shown including piston 158 positioned within chamber 160 and coupled to intake valve $IV_1$. Drain outlet 164 is shown coupled to chamber 160 downstream (with respect to piston stroke) of restricted drain outlet 166. Both drain outlet 164 and restricted drain outlet 166 are shown coupled to fluid input 172 of drain valve 170.

For the particular example presented in FIG. 4, drain valve 170 is shown in its normally open position. Fluid outlet 174 of drain valve 170 is shown coupled to hydraulic return line 78. Drain valve 170 is shown including coils 182 responsive to intake drain command $IDC_1$ and electromagnetically coupled to armature 184. Spool valve 188 is shown coupled to both armature 184 and return spring 192 within casing 194. Hydraulic actuator 140 is coupled to hydraulic return line 78 through drain valve 170 when intake drain command $IDC_1$ is not active.

Supply check valve 194 is shown coupled between hydraulic supply line 72 and fluid inlet 136 of hydraulic actuator 140 for energy recovery purposes. Drain check valve 196 is shown coupled between hydraulic return line 78 and fluid inlet 136 of hydraulic actuator 140 to prevent chamfering.

Figure 5:
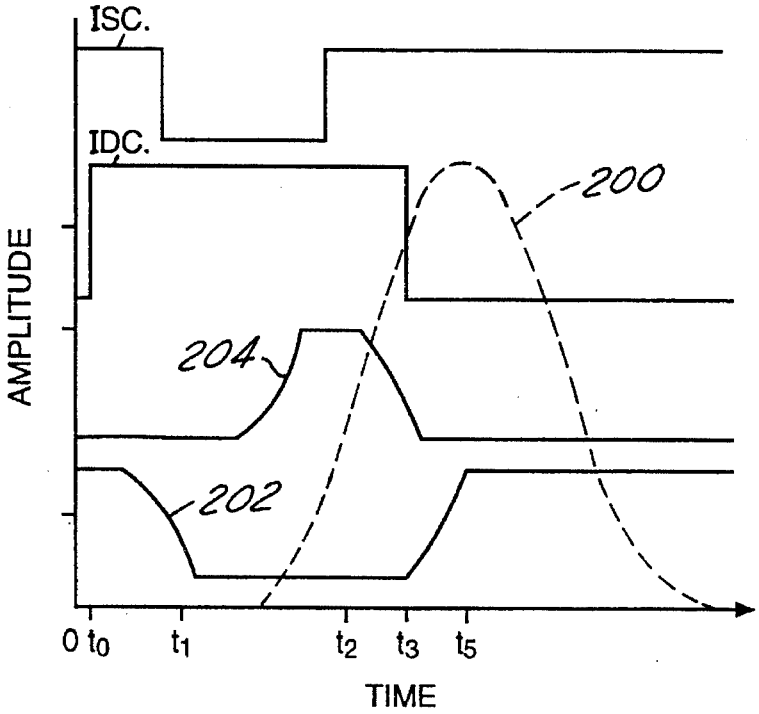
FIGS. 5–7 show various waveforms associated with operation of the valve actuation systems shown in FIGS. 3 and 4.

Operation of valve actuator assembly 62 is now described with continuing reference to FIG. 4 and reference to the waveforms shown in FIG. 5. It is noted that although operation is described with reference to intake valve actuator 62, the operation described herein is equally applicable to valve actuators 64, 66, and 68. In this particular example, the relative timing and pulse width of command signals $ISC_1$ and $IDC_1$ are provided by valve lift/timing controller 42 in response to the $M_2$ displacement command from controller 44 (FIG. 1) for achieving the valve lift profile shown by dashed line 200 in FIG. 5.

It is noted that in this example peak valve lift is limited to maximum lift displacement $M_2$. More specifically, command signal $IDC_1$ is shown becoming active at time $t_0$. In response, drain valve 170 moves from its normally open position to a closed position as shown by line 202. At time $t_1$, intake supply command $ISC_1$ changes to an inactive state for opening normally closed supply valve 144 as shown by line 204. As supply valve 130 opens, pressure builds in chamber 160 of hydraulic actuator 140 pushing down piston 158 and intake valve $IV_1$. Intake supply command $ISC_1$ changes back to its active state at time $t_2$ thereby isolating chamber 160 from hydraulic supply line 72. However, intake valve $IV_1$ continues its downward motion due to inertia thereby reducing pressure in chamber 160 below the pressure in hydraulic return line 78. In response, return check valve 196 opens enabling hydraulic fluid to enter chamber 160 from hydraulic return line 78 to reduce any potential fluid cavitation.

At time $t_3$ intake drain command $IDC_1$ is shown changing to an inactive state for opening normally open drain valve 170 as shown by line 202. The opening of drain valve 170 is timed to approximately correspond with peak excursion of intake valve $IV_1$. As intake valve $IV_1$ moves towards a rest position by action of return spring 156, its motion is restrained by action of the corresponding pressure accumulation in chamber 160. This pressure accumulation, and resulting restraining force, is increased as piston 158 moves past drain opening 164 towards restricted drain opening 166 in chamber 160. Accordingly, a desired lift return profile (line 200) is obtained by judicious selection of both drain opening 164 and restricted drain opening 166 rather than by reliance only on the spring force of return spring 156 as is the case with prior approaches. Stated another way, drain opening and restricted drain opening 166 are utilized as damping orifices for damping return motion of intake valve $IV_1$ in a desired manner.

Figure 6:
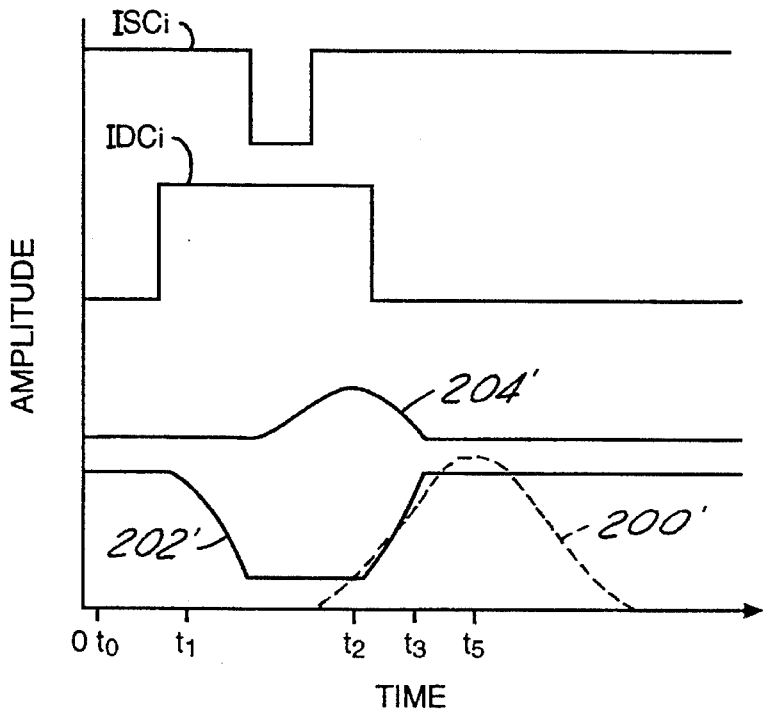

Referring to FIG. 6, wherein like numerals refer to like representations shown in FIG. 5, an example of operation is presented for achieving a reduction in maximum valve displacement to $M_2$. In this particular example, valve lift (200') is centered at approximately the same timing position as the full lift operation shown by line 200 in FIG. 5, but peak valve displacement is limited to $M_2$. Intake supply command $ISC_1'$ and intake drain command $IDC_1'$ are shown delayed in time and reduced in pulse width from the operation schematically shown in FIG. 5. The resulting operation of supply valve 130 and drain valve 170, are shown by respective lines 204' and 202' in FIG. 6. In response to the depicted operation of supply valve 130 and drain valve 170, the operation of valve actuator 62 proceeds in a similar manner to that previously described herein with particular reference to FIG. 5 for achieving the reduced lift profile shown by line 200' in FIG. 6.

Although an electronically actuated, hydraulic actuation system 40 is shown in this example, those skilled in the are will recognize that other valve actuation systems which provide a variable valve lift may be used to advantage. For example, such a system is disclosed in U.S. Pat. No. 4,572,114.

Figure 7:
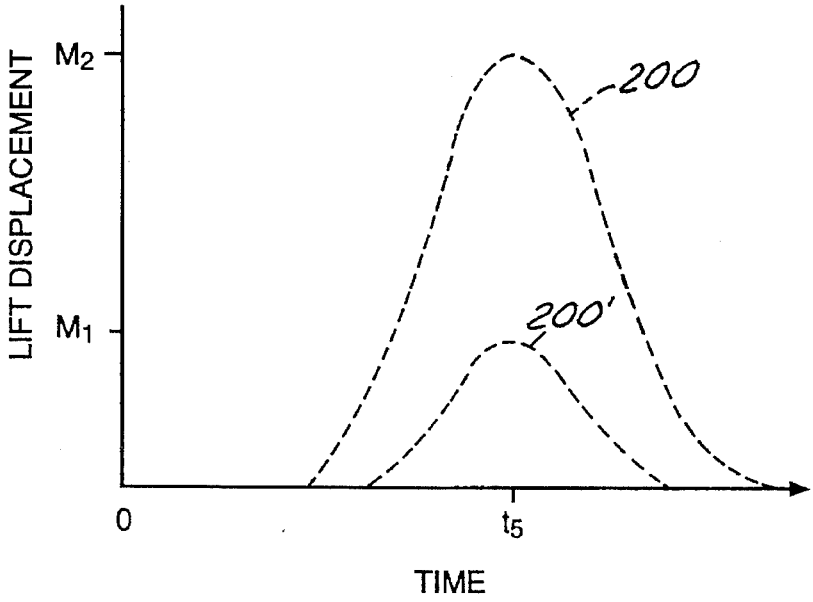

Referring now to FIG. 7, valve lift profiles 200 and 200' are shown superimposed. It is noted that the maximum lift displacement of profile 200' is designated as $M_1$ and the maximum lift displacement of profile 200 is designated as $M_2$. In this particular example, both maximum lift displacements occur at approximately time $t_5$ which is at the midpoint of intake valve stroke. FIG. 7 also illustrates that valve lift profile 200' commences at a later time than valve lift profile 200, by operation of intake valve actuation system 40, such that a greater vacuum is created in the combustion chamber. An increase in inducted mixture flow is thereby provided for enhancing the swirl effect. It is further noted that valve lift profile 200, and the corresponding maximum lift displacement $M_2$, substantially correspond to a conventional internal combustion engine.

Figure 8:
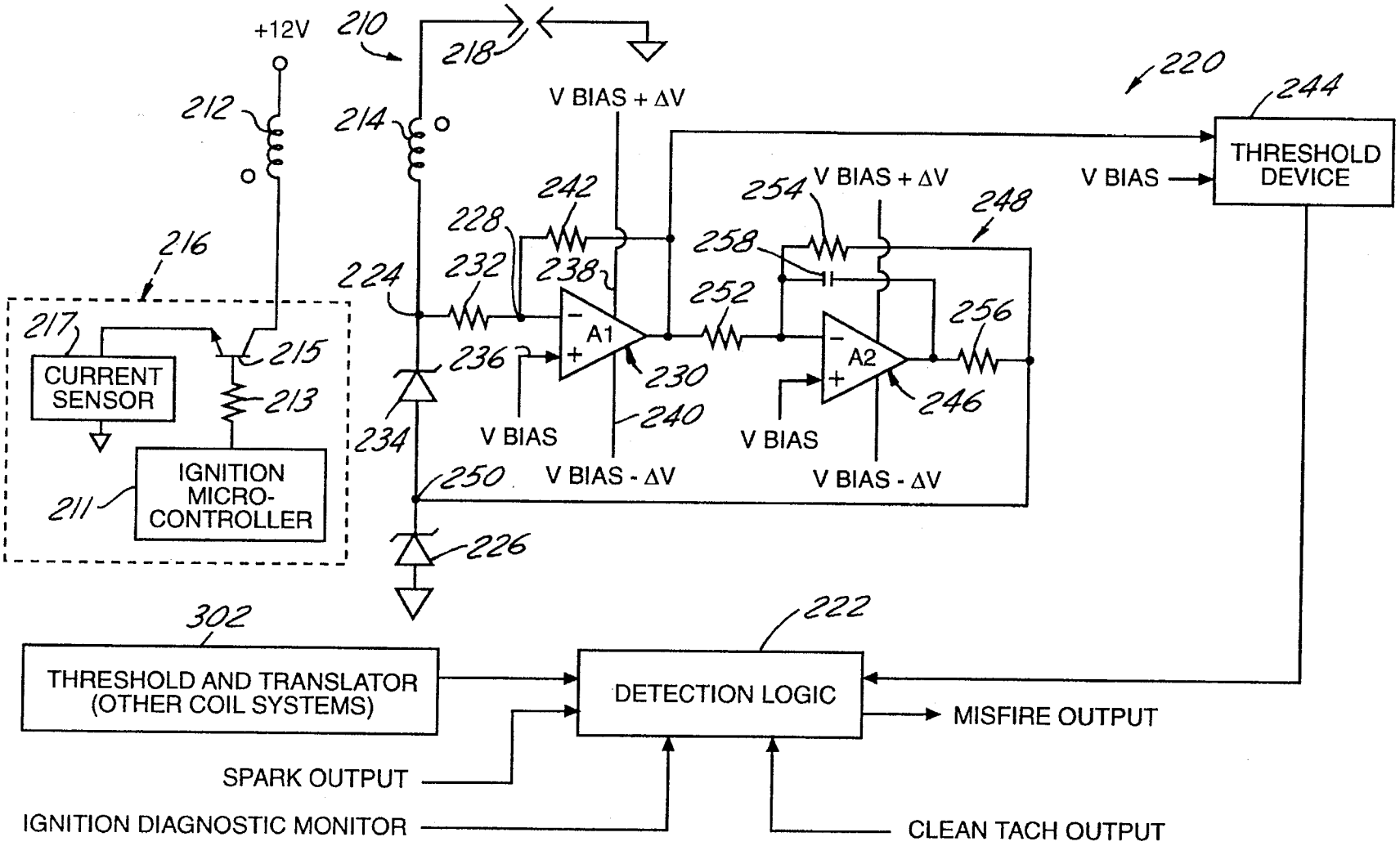
FIG. 8 is a circuit diagram of a misfire detector.

Referring now to FIG. 8, there is illustrated ignition coil 210 of ignition system 200 coupled to sparkplugs $\mathbf{218}_1$, $\mathbf{218}_2$, $\mathbf{218}_3$, and $\mathbf{218}_4$ of engine 12. Ignition coil 210 includes a primary winding 212 and an isolated secondary winding 214. Ignition system 200 includes coil switching device 216, which, in turn, includes ignition microcontroller 211, resistor 213, transistor 215, and current sensor 217.

FIG. 8 also shows circuit 220, for detecting ionic current in the ignition system after combustion of fuel in the engine. A block diagram of detection logic 222 with various vehicle inputs for providing a misfire output signal is also shown. There is only one set of detection logic 222 for the vehicle, not one per cylinder. Also, more than one coil-sparkplug combination can be connected to the input of the circuit 220 at node 224.

Three signals from ignition system 200 are required by the detection logic 222. These are:

1. Ignition Diagnostic Monitor, IDM - The IDM occurs synchronously with the spark event. On positive pulse per firing event used to identify the start of the ignition discharge. The IDM pulse for cylinder 1 has a different pulse width so that cylinder identification and synchronization can be achieved.

2. Clean Tach Output, CTO - One negative pulse per cylinder event. Negative edge occurs 9 crank degrees before top dead center.

3. Spark Output, SPOUT - pulse width encoded signal used by the ionization detection system to determine if ignition is operating in the multi-strike ignition mode.

Figure 9:
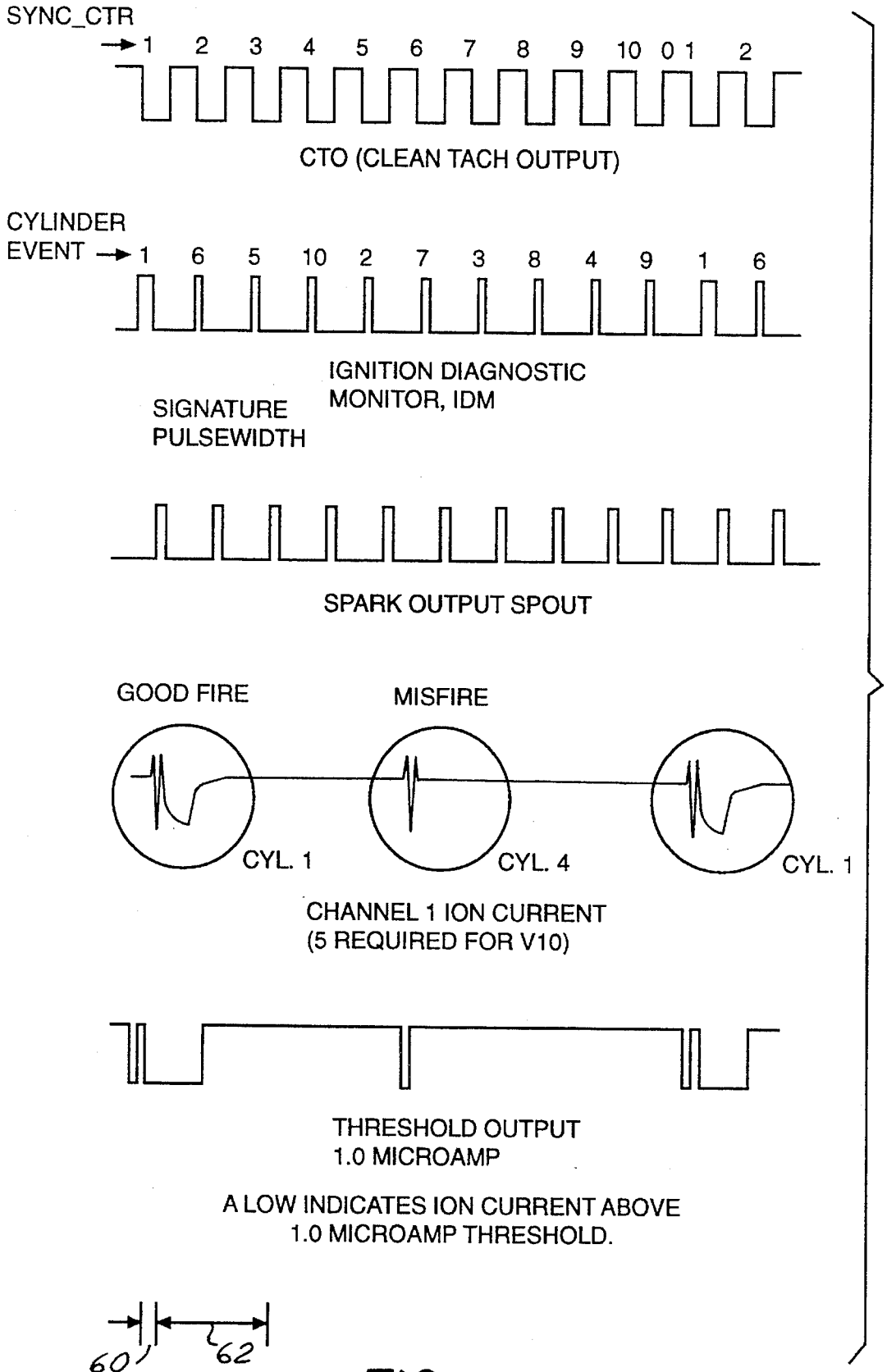
FIG. 9 illustrates various signals associated with ignition timing and misfire detection.

FIG. 9 shows the timing relationships of the CTO, IDM and SPOUT signals previously described. The position of the IDM signal is typically prior to the CTO falling edge but can also follow this edge. FIG. 9 also shows the detailed relationship between CTO, IDM and the ion current signals along with the blanking one shot signal. The blanking one shot is triggered by every spark event including re-strikes and prevents ion current sampling until this spark transient has decayed.

The signal processing algorithm begins when the signature IDM pulse for cylinder #1 is detected. At this point, the ionization detection system is synchronized for cylinder identification. The SPOUT signal is monitored to determine if the ignition is operating in the single strike or multi-strike mode. Upon detection of each subsequent IDM pulse, a blanking window 60 is initiated in the algorithm that has a duration of 2.2 milliseconds if the ignition system operation is single strike and 5.6 milliseconds if the ignition system operation is multi-strike.

Immediately following the blanking window 260, a sampling window 262 is opened to allow sampling of ionization current. The duration of the sampling window 62 is equal to two Clean Tach Output (CTO) periods of crank degrees (or 144 crank degrees) starting at the end of the blanking window 60. A sample is taken approximately every 4.5 crank angle degrees during the sampling window 62.

If the sampled ionization current has not exceeded 1 micro amp, a high level threshold pulse is produced. If the sampled ionization current has exceeded 1 micro amp, a low level threshold pulse is produced. If the number of low level pulses sampled is greater than or equal to two, then a good combustion event is determined. If the number of low level pulses sampled is less than two, then a misfire is determined.

Detection logic 222 then communicates cylinder combustion information to the engine controller. If a good combustion event is determined, detection logic 222 outputs a pulse with a width having a first predetermined length, for example, 512 microseconds. If a misfire is determined, the detection logic 222 outputs a pulse width having a second predetermined length, for example, 1024 microseconds.

Detection logic 222 has been described by the implementation of software. One skilled in the art could also implement detection logic 222 using discrete hardware.

Referring again to FIG. 8, circuit 220 includes Zener diode 226 which carries current in the normal diode direction when the spark event occurs, and carries current in the Zener breakdown mode upon recovery from the spark event. The Zener diode voltage is greater than an ignition detection or bias supply voltage, VBias, applied to the sparkplug by circuit 220. Therefore, the rest of circuit 220 is shut off at the appropriate time after the spark event and before the ion current flow which follows. This maximizes the window for acceptable sampling of the ion current.

In particular, VBias is the ionization detection voltage which is applied to the spark plug 218 through resistor 232 which couples inverting input 228 of operational amplifier 230 to mode 224 which is also coupled to cathode of a first circuit element or Zener diode 234. The anode of Zener diode 234 is connected to the cathode of Zener diode 226.

The non-inverting input 236 of operational amplifier 230 is biased with the ionization detection voltage. Operational amplifier 230 also includes power supply voltages VBias+ ΔV at input 238 and voltage VBias −ΔaV at input 240.

A first feedback circuit in the form of feedback resistor 242 allows a mirror image (around 40 V) of the ionization detection voltage to be generated from inverting input 228 to the output of operational amplifier 230.

After the ionization detection voltage has been applied to spark plug 218, operational amplifier 230 generates a signal at its output having a magnitude based on the input voltage signal appearing at node 224. The magnitude of the output signal from operational amplifier 230 is compared with a predetermined threshold such as the ignition detection voltage at a threshold device, generally indicated at 244.

Figure 10:
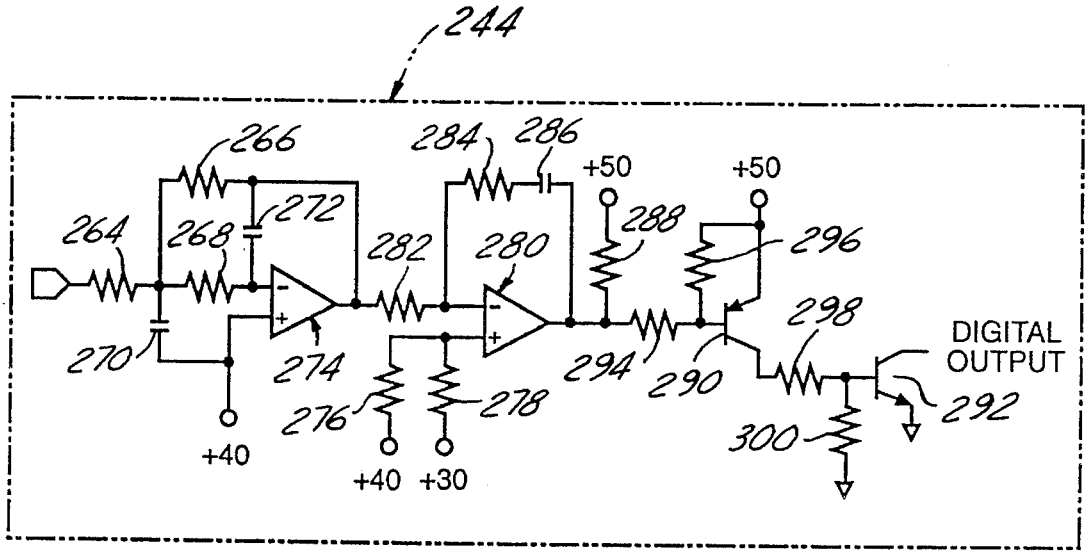
FIG. 10 is circuit diagram of a threshold detector.

Referring to FIG. 10, threshold device 244 is now described. Input into threshold device 244 is obtained from the output of operational amplifier 230. Device 244 includes resistors 264, 266, and 268, capacitors 270 and 272, and operational amplifier 274 which collectively define an inverting unity gain amplifier.

The output of the operational amplifier 274 is centered around a bias voltage of 40 Vdc in this particular example. When ionization is present, the output of operational amplifier 274 will drop from the 40 Vdc reference by an amount that is proportional to the magnitude of ionization.

Circuit 244 also includes resistors 276 and 278 and operational amplifier 280. Resistors 276 and 278 define a divider network that determines the threshold level of the comparator 280. Circuit 244 also includes resistors 282 and 284 and capacitor 286.

The level of threshold voltage is set to 39.5 Vdc in this example. When the output of operational amplifier 274 falls below 39.5 Vdc, the output of comparator 280 will be pulled up to 50 Vdc through resistor 288. If the output of the operational amplifier 274 is above 39.5 Vdc, then the output of the comparator 280 will switch to the lower rail voltage of 30 Vdc. If the output of the comparator 280 is a low level, then transistor 290 is biased which, in turn, provides a bias to transistor 292 and will cause transistor 292 to also turn on, pulling the digital output to ground level, thereby translating the level from VBias+Δ V to ground level. Circuit 244 typically includes resistors 294, 296, 298, and 300.

When the level of ionization current has exceeded 1 microamp, the input voltage to operational amplifier 280 will be below 39.5 Vdc and the digital output will turn off and the output voltage will be pulled up to a level established by the detection logic 222. If the level of ionization current is below 1 microamp, the input voltage to operational amplifier 280 will be above 39.5 Vdc and the digital output of transistor 292 will be at zero volts. The output of threshold device 244 is coupled to the detection logic 222 to determine whether a misfire output signal should be generated by the detection logic 222 as previously described.

In order to avoid Zener diode leakage, two Zener diodes 226 and 234 are utilized and a guard voltage signal is generated by second operational amplifier 246 and its respective feedback circuitry, generally indicated at 248. The guard voltage signal is applied to the node and junction 250 between Zener diodes 234 and 226. The guard voltage is regulated to track the input voltage appearing at the cathode of the Zener diode 234 by feedback circuit 248 surrounding the operational amplifier 246.

Because the guard voltage is essentially the same as an input voltage appearing at node 224, there is no leakage current flow through Zener diode 234. Therefore, any voltage developed at threshold device 244 is attributable exclusively to ionization current and very low signal levels can be detected.

Ionization detection circuit 220 depicts a single channel. An identical circuit is required for each channel. A single channel can monitor two cylinders that fire 360 degrees apart. Therefore, additional channels would be monitored by additional circuits 220 and can be coupled to detection logic 222 as indicated by threshold and translator 302.

Figure 11:
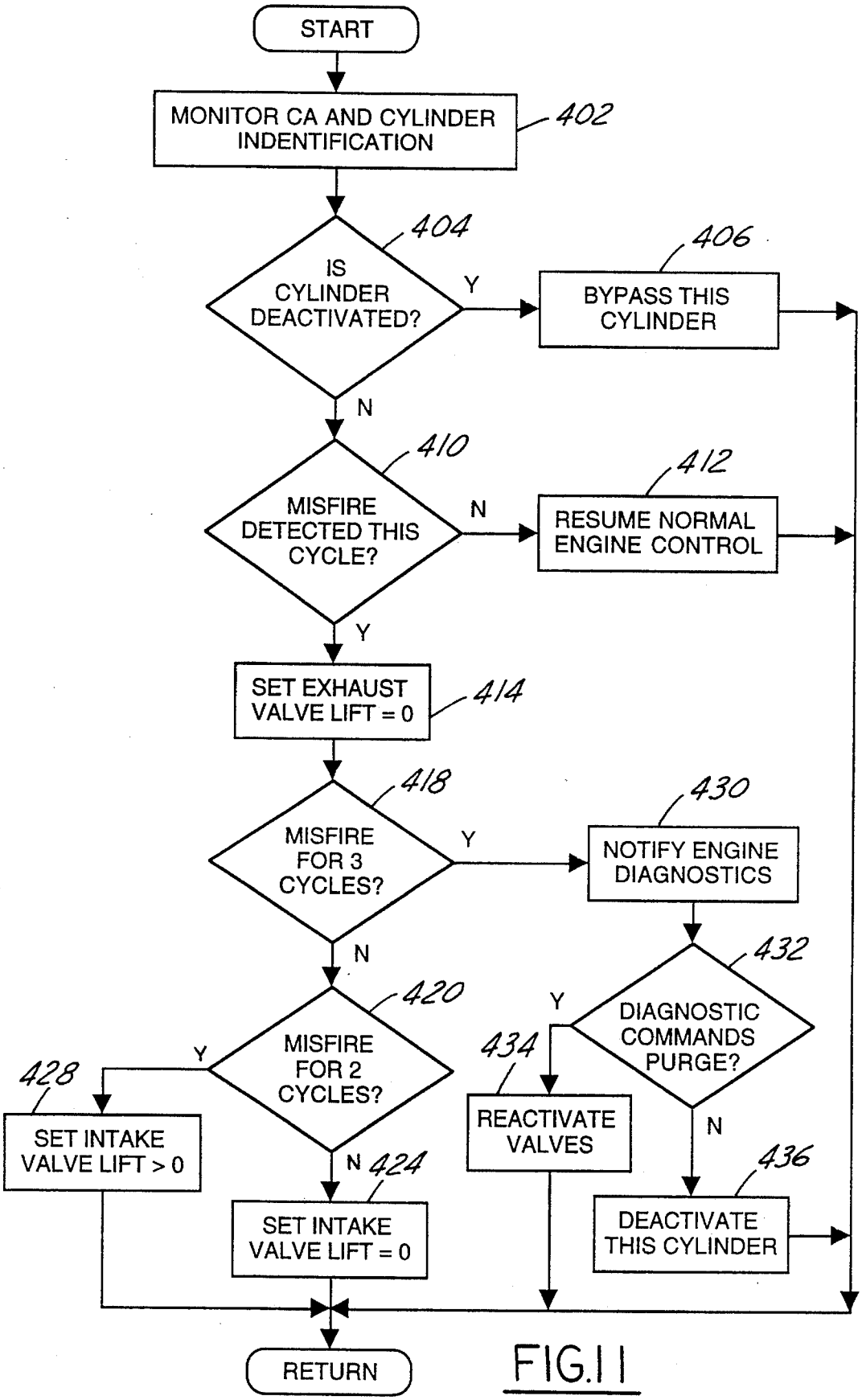
FIG. 11 is a subroutine for controlling valve lift/timing in response to engine misfire.

Referring now to FIG. 11, the subroutine for controlling valve lift/timing controller 42 in response to engine misfire is now described. A particular cylinder of engine 12, which is in its ignition cycle, is first identified by monitoring crank angle position (CA) from engine 12 and a cylinder identification signal (not shown) from distributorless ignition system 200 (Step 402). A determination is then made (Step 404) whether this particular cylinder is being deactivated for reasons such as traction control or because a variable displacement engine control has commanded deactivation of a number of cylinders (Step 404). In the event of deactivation, this cylinder is bypassed and the subroutine exited (step 406).

If the particular cylinder being evaluated during this subroutine has not misfired during this engine cycle (step 410), then normal engine control is resumed (step 412). On the other hand, if the particular cylinder being evaluated during this subroutine has misfired this engine cycle (step 410), the exhaust valve lift for this cylinder is set equal to zero (step 414) such that the air/fuel charge for this cylinder which has not been properly ignited is retained in this cylinder for ignition during the next engine cycle (step 414).

In the event this is the first engine cycle that this cylinder has misfired (steps 418 and 420), then the intake valve lift is also set equal to zero (step 424). If this cylinder has misfired for two successive engine cycles, but not three engine cycles (steps 418 and 420), then the valve lift for this cylinder is partially opened (step 428). A fresh air/fuel charge thereby enters the cylinder to mix with the existing air/fuel charge which has failed to ignite. Stated another way, the existing air/fuel charge is refreshed to enhance ignition during the next engine cycle.

In the event that the particular cylinder being evaluated during this subroutine has misfired for three successive engine cycles (step 418), the engine diagnostic system is notified (step 430). In response to the engine diagnostics (step 432), either a purge is commanded in which case the intake and exhaust valves for this cylinder are reactivated (step 434), or this cylinder is deactivated (step 436).

This concludes the description of the preferred embodiment. The reading of it by those skilled in the art will bring to mind many modifications and alterations without departing from the spirit and scope of the invention. For example, although an ionization detector was shown herein for misfire detection, conventional pressure sensors may also be used to advantage. Further, there are numerous other forms of valve control and valve hardware which provides individual cylinder valve control. Accordingly, it is intended that the invention be limited only by the following claims.

What is claimed:

1. A control system for a multi-cylinder engine, comprising:

a misfire detector for detecting a misfire in at least one of the cylinders; and a valve controller for controlling an exhaust valve of said cylinder, said valve controller at least partially closing said exhaust valve in response to said misfire detection.

2. The control system recited in claim 1 wherein said valve controller further controls an intake valve of said cylinder and said valve controller at least partially closes said intake valve in response to said misfire detection.

3. The control system recited in claim 2 wherein said valve controller reactivates said exhaust valve and said intake valve in response to an absence of said misfire detection.

4. The control system recited in claim 2 wherein said valve controller increases valve lift of said intake valve in response to a plurality of said misfire detections.

5. The control system recited in claim 2 wherein said valve controller closes said intake valve in response to said misfire detection when said misfire detection was absent during said cylinder's previous ignition cycle.

6. The system recited in claim 2 wherein said valve controller partially opens said intake valve in response to said misfire detection during said cylinder's previous ignition cycle.

7. The system recited in claim 6 wherein said valve controller partially opens said intake valve in response to said misfire detection during two previous successive ignition cycles of said cylinder.

8. The control system recited in claim 1 wherein said misfire detector comprises a pressure sensor.

9. The control system recited in claim 1 wherein said misfire detector comprises an ionization detector coupled to said cylinder.

10. The control system recited in claim 9 wherein said ionization detector further comprises a voltage source and a current detector coupled to a spark plug connected to said cylinder.

11. A control system for a multi-cylinder engine, comprising:

a misfire detector for detecting a misfire in each of a plurality of the engine cylinders;

a valve controller for controlling exhaust valves and intake valves of each of the cylinders;

said valve controller closing both said intake valve and said exhaust valve of one of the cylinders in response to a misfire detection for said cylinder; and said valve controller at least partially opening said intake valve in response to two successive occurrences of said misfire detection for said cylinder.

12. The control system recited in claim 11 wherein said valve controller reactivates said exhaust valve in response to a predetermined number of successive occurrences of said misfire detection for said cylinder.

13. The control system recited in claim 11 wherein said valve controller reactivates said exhaust valve and said intake valve in response to an absence of said misfire detection.

14. A control method for a multi-cylinder engine having a valve controller for controlling exhaust valves and intake valves of each of the cylinders and a misfire detector coupled to each of the cylinders, comprising the steps of:

detecting an ignition misfire for each of the cylinders for each ignition cycle of each of the cylinders;

setting valve lift of an exhaust valve of one of the cylinders to zero in response to a misfire detection for said cylinder;

setting valve lift of an intake valve of said cylinder to zero in response to said misfire detection for said cylinder when said misfire detection was absent during said cylinder's previous ignition cycle; and setting said intake valve lift to a predetermined lift in response to two successive misfire detections for said cylinder.

15. The control method recited in claim 14 further comprising a step of restoring normal valve lift control for said intake valve and said exhaust valve when said misfire detection is absent during said cylinder's ignition cycle.

16. The control system recited in claim 15 further comprising a step of applying a voltage to a spark plug coupled to said cylinder during a portion of said cylinder's ignition cycle and measuring current flowing between electrodes of said spark plug to provide said misfire detection.

* * * * *